US006382189B1

(12) United States Patent
Hlousek

(10) Patent No.: US 6,382,189 B1
(45) Date of Patent: May 7, 2002

(54) HIGH-PRESSURE FUEL INJECTOR WITH HYDRAULICALLY CONTROLLED PLATE CAM

(75) Inventor: Jaroslaw Hlousek, Golling (AT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/868,727

(22) PCT Filed: Oct. 20, 2000

(86) PCT No.: PCT/DE00/03692

§ 371 Date: Oct. 9, 2001

§ 102(e) Date: Oct. 9, 2001

(87) PCT Pub. No.: WO01/29410

PCT Pub. Date: Apr. 26, 2001

(30) Foreign Application Priority Data

Oct. 21, 1999 (DE) ..... 199 50 779

(51) Int. Cl.[7] ..... F02M 37/04
(52) U.S. Cl. ..... 123/506; 123/467; 251/50
(58) Field of Search ..... 123/456, 467, 123/446–447, 506; 251/50, 54

(56) References Cited

U.S. PATENT DOCUMENTS

| | | | | |
|---|---|---|---|---|
| 4,180,038 A | * | 12/1979 | Steinwart et al. | |
| 4,957,275 A | * | 9/1990 | Homes | 251/50 |
| 5,118,076 A | * | 6/1992 | Homes | 251/50 |
| 5,239,968 A | * | 8/1993 | Rodriquez-amaya et al. | 123/506 |
| 6,059,545 A | * | 5/2000 | Straub et al. | 251/50 |
| 6,161,813 A | * | 12/2000 | Baumgartner et al. | 251/50 |

* cited by examiner

*Primary Examiner*—Thomas N. Moulis
(74) *Attorney, Agent, or Firm*—Ronald E. Greigg

(57) ABSTRACT

The invention relates to a fuel injection device for internal combustion engines. A high-pressure reservoir (common rail) can be made to communicate with an injection nozzle via a 3/2-way valve having has a control valve member which connects a supply line to a high-pressure line or to a relief line discharging into a tank. On its end regions, opposite the stops, the control valve member is provided with elements 7, 21; 6, 22 that damp the stroke of the control valve member.

12 Claims, 2 Drawing Sheets

14
4
18
55
16
30
17
15
6
22
5
28
3
19'
10
1
19
7'
20
9
20'
P
26
11
7
13
25
12
21
8
29
2
24

HIGH-PRESSURE FUEL INJECTOR WITH HYDRAULICALLY CONTROLLED PLATE CAM

CROSS-REFERENCE TO RELATED APPLICATIONS

This application is a 35 USC 371 application of PCT/DE 00/03692 filed on Oct. 20, 2000.

BACKGROUND OF THE INVENTION

1. Field of the Invention

In high-pressure fuel injectors, 3/2-way valves are used that include control slides, whose reciprocating motion influences the course of injection. The control slides execute reciprocating motions in the housing of a 3/2-way valve, and the seat faces and control edges of the control slide are exposed to severe stresses.

2. Prior Art

In 3/2-way valves, the control slides that enable the supply of fuel to the injection nozzle and block it are surrounded by a housing. The control slides and housing bores are made with the narrowest possible tolerances in terms of diameter, so as to achieve the most precise possible fuel metering and to keep leakage losses slight. The fuel metering is done via control edges on the outlet and inlet sides and is dependent on the stroke of the control slide in the housing of the 3/2-way valve. The mechanical stresses on the seat faces are very severe, since the motions of the control slide occur quite extensively undamped.

If the control slides in the 3/2-way valve housings execute only short reciprocating motions, then because of the short stroke travel only limited influence on the course of injection ensues. Since the course of fuel injection in an internal combustion engine, however, is highly significant for the course and completeness of combustion inside the cylinders, shaping of the injection course to optimize the course of combustion and for the sake of complete utilization of the internal energy of the fuel appears to be an indispensable method parameter that is dependent on the control stroke of the control valve member.

SUMMARY OF THE INVENTION

With the terminal-position damping, proposed according to the invention, of the control valve member inside the housing of the 3/2-way valve, the reciprocating motion in the terminal positions is damped in such a way that the service life of this component inside the 3/2-way valve housing increases considerably. As hydraulically acting dampers, diameter pairs offset from one another on the end regions of the control slide can be embodied, with which a pressure equilibrium can be generated in the chambers that surround the end regions of the control slide; as a result, the reciprocating motions of each control slide are damped. Thus the service life of the cylindrical element functioning as a control slide can be lengthened considerably. If the stop faces, opposite the end faces of the control slide, are embodied as flat annular faces, then on the one hand machining is simpler, and on the other, the wear resistance of a stop face embodied in this way is considerably higher, compared with a conical seat, for instance.

At the onset of injection, an actuator provided above the upper control chamber can be triggered, and as a result the pressure in the upper control chamber is lowered, which in turn moves the control slide to its upper terminal position. As a result, the inflow to the injection nozzle is opened and the injection nozzle is subjected to the fuel, which is at pressure.

The control valve member is preferably surrounded by a sleeve that is shrink-fitted into the housing of the 3/2-way valve and can thus easily be replaced if repair is necessary. The injector housing can be made from inexpensive material, while in this variant only the sleeve can be made from high-quality material. The control edges that result between the sleeve, shrink-fitted into the housing of the 3/2-way valve, and the shoulders of the control valve member, are made with close tolerances, so that minimal leakage ensues. By covering the control edges at the control valve member and at the shrink-fitted sleeve on the outlet and inlet side of the control valve member, minimal leakage losses are attainable, and the leakage can be returned to the fuel tank via a relief line.

Controlling the course of injection can be brought about by way of a stroke-dependent throttling, if the actuator above the upper control chamber is embodied as a piezoelectric actuator, for instance. A step can be made on the control valve member below the inlet-side control edge, and with this step an inlet-side throttling is attainable as a function of the stroke of the control valve member.

BRIEF DESCRIPTION OF THE DRAWINGS

The invention will be described in detail herein below in conjunction with the drawing, in which.

DESCRIPTION OF THE PREFERRED EMBODIMENTS

Figure 1:
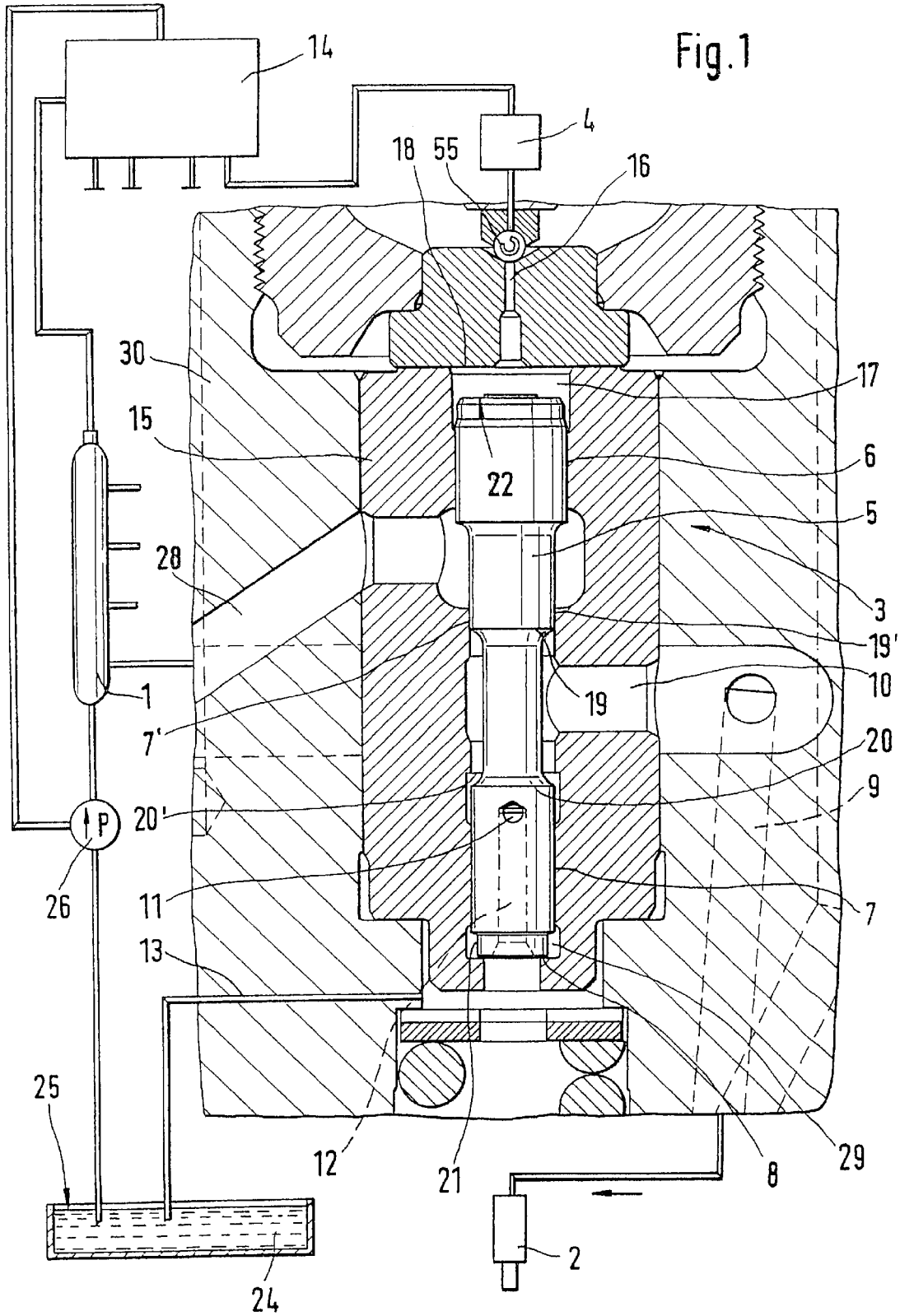
FIG. 1 is a sectional view of the modular 3/2-way valve assembly, schematically illustrated between the common rail and the injection nozzle.

In the view of FIG. 1, the 3/2-way valve unit 3 provided between the high-pressure reservoir 1 (common rail) and the injection nozzle 2 is disclosed.

From a fuel tank 24, a supply line leads to a high-pressure pump 26, into which a return flow line 27 discharges and which subjects a common rail 1 to fuel which is at high pressure. From the common rail 1, supply lines 28 lead to the respective 3/2-way valve units 3, of which one is shown here in greater detail. By means of a control unit 14, both the common rail 1 and an actuator 4 can be triggered, with which actuator a control chamber 17 disposed above the control valve member 5 can be depressurized.

At the control valve member 5, surrounded by a sleeve 15 of high-quality material that is shrink-fitted into the housing 30, the upper end region is embodied with a diameter 6, while the region directly adjoining the end face is embodied with a diameter 22 that is reduced by comparison. In the state shown in FIG. 1, the upper end region of the control valve member 5 having the stepped diameters 22, 6 protrudes into the control chamber 17. If the control chamber is closed by the actuator 4, when no current is delivered to it, and the 2/2-way valve 55, then the diameter step 22, 6 acts as a hydraulic damping element for the control valve member 5.

In the direction of the narrowing middle region of the control valve member 5, there are inlet-side control edges 19, 19', which upon upward motion of the control valve member 5 from depressurization of the control chamber 17 uncover the inlet-side inlet opening to the high-pressure line 9 at the injection nozzle 2. In the open state, the fuel which is at high pressure passes through the supply line 28 into the sleeve 15 and there enters the high-pressure line 9 through the opening uncovered by the control edges 19, 19'. At this instant—because of the coverage of the control edge faces 19, 19' and 20, 20'—the outlet-side opening is closed, so that no leakage losses occur at the control valve 5. Once injection has occurred, the control valve member 5 assumes the position shown in FIG. 1; the inlet-side control edges 20, 20' are opened, and the fuel can flow through the diversion bore 11 and the overflow conduit 12 in the lower region of the control valve member 5 to enter the relief line 13, which in turn discharges into the fuel tank 24 again.

The part of the control valve member 5 that receives the overflow conduit 12 is embodied with a diameter 7 that is surrounded by the sleeve 15, which is embodied with a diameter 7'; as a result, the closest possible tolerances and hence the least possible leakage losses can be achieved. Below the region of the control valve member 5 that is embodied with the diameter 7, a further diameter region 21 is provided, which has a diameter 21 that is somewhat less than the diameter 7. Analogously to the upper end region of the control valve member 5, in the lower end region there is a pronounced diameter graduation 7, 21, which in the downward motion of the control valve member 5 acts as a damping element on the control valve member and counteracts premature wear of the lower stop of the sleeve 15. The mode of operation of the control valve 5 surrounded by the sleeve 15 is as follows:

When the electric actuator 4 lacks current, the connection between the high-pressure reservoir 1 (common rail) and the injection nozzle 2 is interrupted. The fuel at high pressure which is present via the supply line 28, is available at the control valve member 5. Because of the tight fit 7, 7' in the region of the control edges 19, 19', the in let opening into the high-pressure line 9 to the injection nozzle 2 is blocked. The nozzle chamber 2 together with the relief line 13, overflow conduit 12, diversion bore 11 and bores 10 and the high-pressure line 9 remains pressureless. If after the actuation of the actuator 4 via triggering of the 2/2-way valve 55 and opening of the valve throttle 16 the control chamber 17 is depressurized, then the control valve member 5 moves upward against the contact face 18. Because of the graduated diameters 6, 22, the reciprocating motion of the control valve member 5 is damped upon approaching the upper, flat annular face of the stop 18. The flow cross section at the diameter 6, or in other words the play between the control valve member 5 and the guide sleeve 15 is dimensioned to be less than the cross section of the valve throttle 16 at the upper stop 18. In the upward motion, the outlet-side control edges 20, 20' close the outlet opening, while the inlet-side control edges 19, 19' uncover the inlet opening into the high-pressure line 9. During the upward reciprocating motion of the control valve member 5, its impact against the annular face 18 is damped by the graduated diameter 6, 22. During the downward motion, which ensues from shutting off the actuator 4, the control valve 5 migrates in the direction of the lower stop 8 and, since the high pressure now prevails in the control chamber 17 as well, closes the inlet openings into the high-pressure line 9 by means of the downward-moving control edges 19, 19'. In the downward motion of the control valve member 5, an overflow of the fuel takes place, via the diversion bore 11 and the overflow conduit 12, into the relief line 13 that leads to the tank 24. The damping of the downward motion of the control valve member 5 is effected by the graduated diameters 17, 22 which in the damping chamber 29 in the lower region of the sleeve 15 have an equally damping effect on the reciprocating motion of the control valve member 5 in the sleeve 15 surrounding it.

The 3/2-way valve 3 of the invention can be received directly in the injector or can be designed as a mounting unit that can be built in between the high-pressure reservoir 1 (comm on rail) and the injection nozzle 2.

Figure 2:
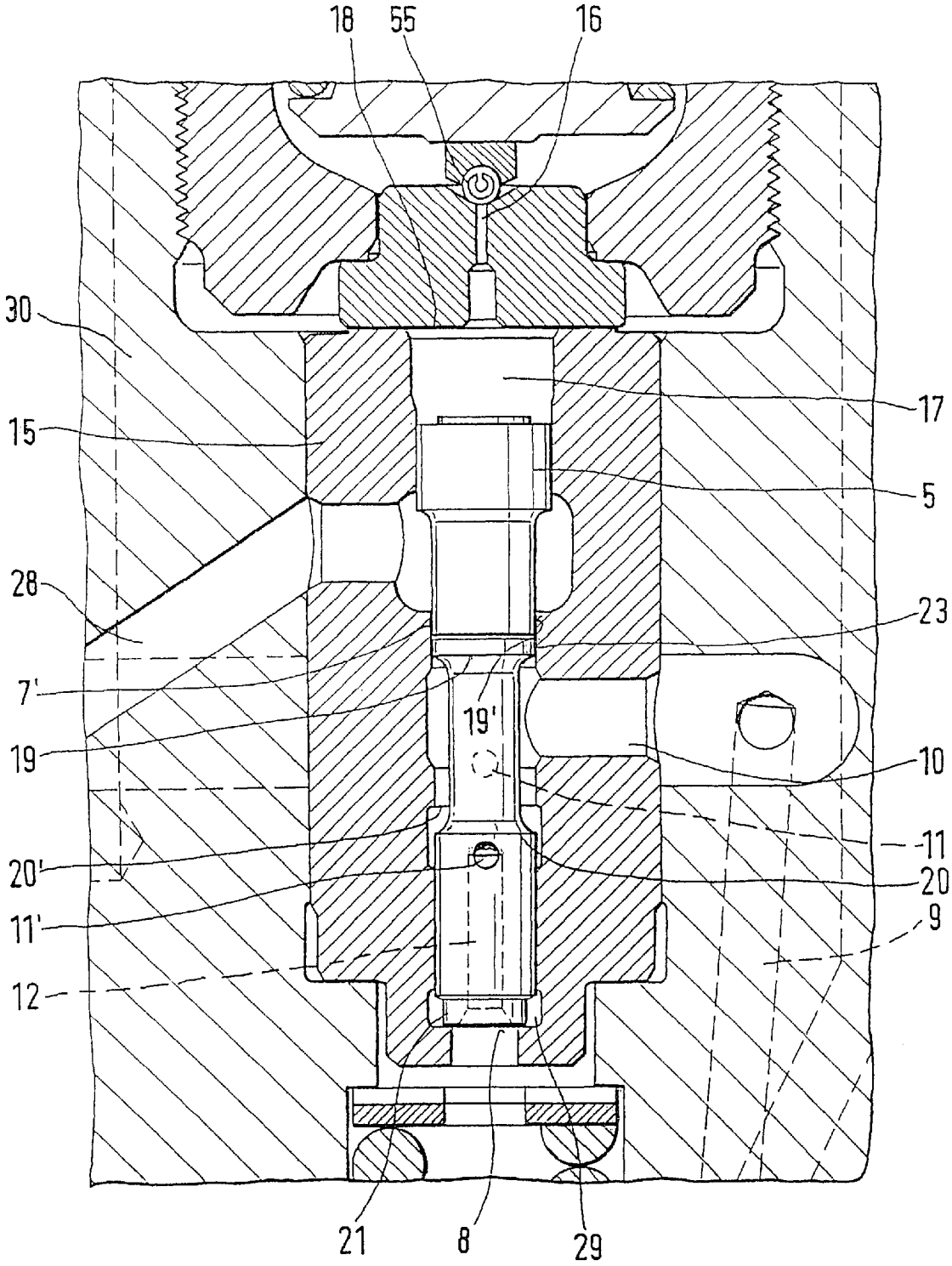
FIG. 2, the control valve member, which is movable in a shrink-fitted sleeve, with the inlet-side step that shapes the course of injection.

In the view of FIG. 2, a control valve member 5 that is inovable in a shrink-fitted sleeve 15 is shown along with an inlet-side step 23 that shapes the course of injection.

Below the inlet-side control edges 19, 19' on the control valve member 5, a step 23 is shown, which for instance tapers conically in the direction of the lower stop 8, and with which the course of the injection can be varied by means of throttling as a function of the stroke of the control valve member 5. Further shaping and variation of the course of injection could be achieved by a variable throttling at the 2/2-way valve 55, for instance by means of a piezoelectric actuator. By a suitable disposition of the inlet-side control edge 19, 19' and of the outlet-side control edges 20, 20', the system pressure can be reduced in the first opening phase.

Security against the occurrence of an undesired and uncontrollable inlet quantity can be provided if the control valve 5 in normal operation is not moved as far as the stop 18 but instead the contact between the upper region of the control valve member 5 and the annular face 18 takes place only in the event of failure of the actuator 4 or the 2/2-way valve 55. If these components should fail, the diversion bore 11 can move to the position marked 11', and as a result a pressure relief of the injection nozzle 2 can take place by an outflow of fuel, which is at high pressure, into the tank 24 via the overflow conduit 12 and the pressure relief line 13. As a result, if control components 4, 55 fail, the remaining components are protected against excessive mechanical stresses that might occur.

The foregoing relates to preferred exemplary of embodiments of the invention, it being understood that other variants and embodiments thereof are possible within the spirit and scope of the invention, the latter being defined by the appended claims.

I claim:

1. A fuel injection device for internal combustion engines, comprising a high-pressure reservoir or common rail (1), which can be made to communicate with an injection nozzle (2) via a 3/2-way valve (3) and a control valve member (5) connecting a supply line (28) to a high-pressure line (9) or to a relief line (13) discharging into a tank (24), said control valve member (5) on its end regions, opposite stops (8, 18), includes elements (7, 21; 61, 22) that damp the stroke of the control valve member (5).

2. The fuel injection device of claim 1, wherein damping elements are each embodied as a reduced diameter (7, 21; 6, 22) on the end regions of the control valve member (5).

3. The fuel injection device of claim 1, wherein the end regions of the control valve member (5) each dip into chambers (17, 29) for damping the reciprocating motion.

4. The fuel injection device of claim 3, wherein the pressure in the upper chamber (17) can be depressurized by a valve throttle (16).

5. The fuel injection device of claim 1, wherein a sleeve (15) surrounding the control valve member (5) is shrink-fitted into the housing of the 3/2-way valve (3).

6. The fuel injection device of claim 5, wherein the interchangeable sleeve (15) surrounding the control valve member (5) comprises high-quality material.

7. The fuel injection device of claim 1, wherein a 2/2-way valve (55) above the control chamber (17) is triggered by means of an electric actuator (4).

8. The fuel injection device of claim 7, wherein throttling that is dependent on the stroke of the control valve member (5) makes a stroke-controlled piezoelectric actuator possible.

9. The fuel injection device of claim 1, wherein the 3/2-way valve unit (3) is accommodated in modular fashion between a common rail (1) and an injection nozzle assembly (2).

10. The fuel injection device of claim 1, wherein a step (23) that shapes the course of injection is embodied on the control valve member (5) in the region of the inletside control edge (19, 19').

11. The fuel injection device of claim 1, wherein the quantity losses upon injection are minimized by covering the control edges (19, 19'; 20, 21) between the control valve member (5) and the sleeve (15).

12. An internal combustion engine with a fuel injection device comprising a high-pressure reservoir (1) (common rail), which can be made to communicate with injection nozzles (2) via a 3/2-way valve (3), and a control valve member (5) connecting a supply line (28) to a high-pressure line (9) or to a relief line (13) discharging into a tank (24), said the control valve member (5) on its end regions, opposite the stops (8, 18), including damping elements (7, 21; 6, 22) that damp the stroke of the control valve member (5).

* * * * *